United States Patent [19]

Grohe

[11] Patent Number: 4,523,734

[45] Date of Patent: Jun. 18, 1985

[54] HOLDING DEVICE FOR A SHOWER POST

[75] Inventor: Klaus Grohe, Schiltach, Fed. Rep. of Germany

[73] Assignee: Hans Grohe GmbH & Co. KG, Fed. Rep. of Germany

[21] Appl. No.: 520,713

[22] Filed: Aug. 5, 1983

[30] Foreign Application Priority Data

Sep. 9, 1982 [DE] Fed. Rep. of Germany ..... 3233495

[51] Int. Cl.[3] ..... A47H 1/14

[52] U.S. Cl. ..... 248/251; 264/1.9

[58] Field of Search ..... 248/251, 544; 211/123, 211/105.1; 264/1.9; 403/245, 246; 350/103; 428/912.2; 40/596, 551–552

[56] References Cited

U.S. PATENT DOCUMENTS

| | | | |
|---|---|---|---|
| D. 266,122 | 9/1982 | Haug | D6/86 |
| 1,117,771 | 11/1914 | Boehm | 248/251 |
| 2,253,346 | 8/1941 | Patton | 248/27.1 |
| 2,286,085 | 6/1942 | Haggart, Jr. | 350/103 |
| 2,956,767 | 10/1960 | Unetic | 248/251 |
| 3,259,350 | 7/1966 | Lüder | 248/251 |
| 3,384,333 | 5/1968 | Bohlman | 248/251 |
| 3,905,679 | 9/1975 | Langenbach | 350/103 |

FOREIGN PATENT DOCUMENTS

| | | | |
|---|---|---|---|
| 2821368 | 11/1979 | Fed. Rep. of Germany | 248/251 |
| 145398 | 5/1931 | Switzerland | 248/251 |
| 597444 | 4/1978 | Switzerland . | |

OTHER PUBLICATIONS

*University Physics*, F. W. Sears & M. W. Zemansky 1955, pp. 733–735.

*Primary Examiner*—William H. Schultz
*Assistant Examiner*—Robert A. Olson
*Attorney, Agent, or Firm*—Steele, Gould & Fried

[57] ABSTRACT

The holding device for a shower post is provided with a holding member, which can be fixed by a fixing element to a wall and which can be coupled to the shower post. At least the outer wall surface of the holding member is made from a transparent to clear material and is made matt to reflecting on the inside by an unglazed design. In conjunction with the transparent construction of the outer wall surface, this ensures that it is not possible to see into the interior of the holding member, the latter assuming the color of the wall to which the holding member is fixed.

10 Claims, 2 Drawing Figures

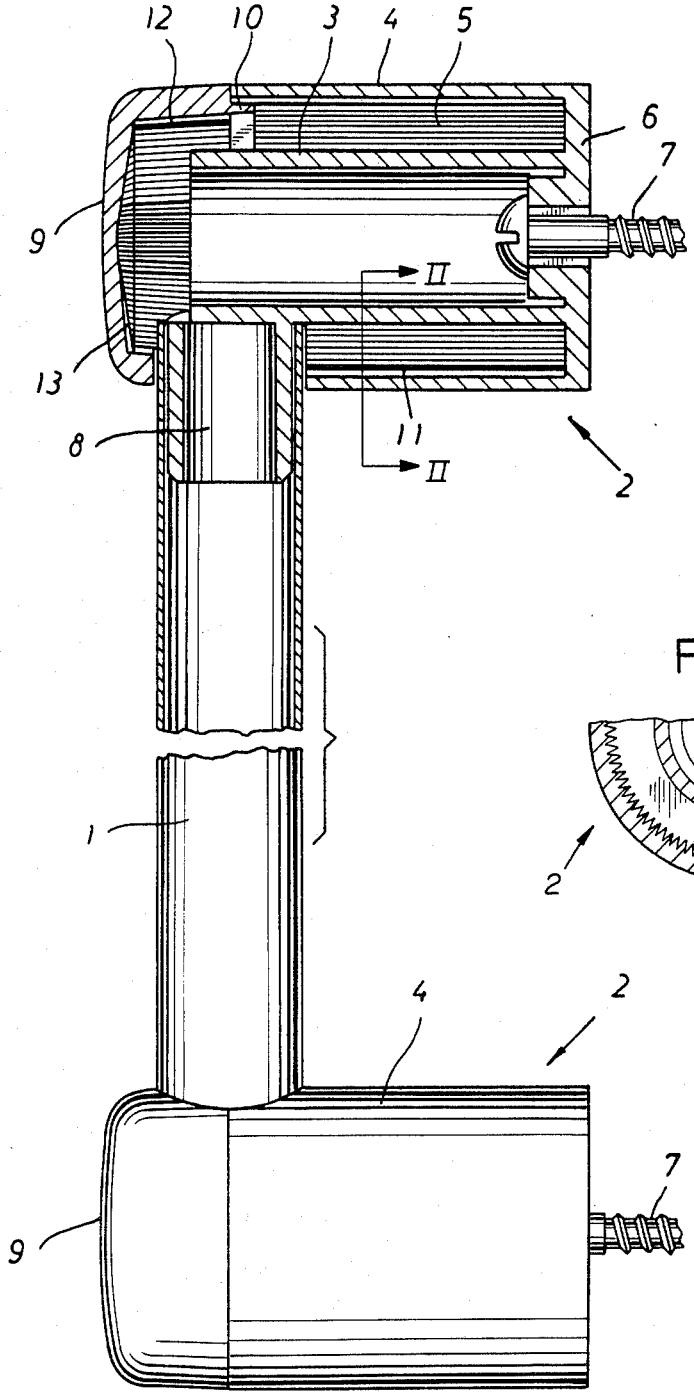
FIG. 1
FIG. 2
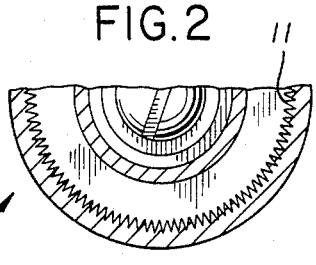

HOLDING DEVICE FOR A SHOWER POST

BACKGROUND OF THE INVENTION

The invention relates to a holding device for a shower post with at least one holding member, which can be fixed to a wall by means of a fixing element, which can be coupled to the shower post and which keeps the shower post at a distance from the wall.

The known holding devices of this type generally have a very complicated construction and are expensive to manufacture. Their surface is generally chromium-plated or nickel-plated, which is considered disadvantageous by the user, who now frequently wants bathroom fittings and holding devices which match his wall tiles.

It is possible to make shower post holding devices from coloured plastic, so that the user can choose any desired colour for his holding device from the available colour range. However, this would greatly increase storage costs both for the manufacturer and for the dealer and this would have an effect on the final selling price.

SUMMARY OF THE INVENTION

The problem of the invention is to provide a holding device of the aforementioned type, which has a simple construction, which is inexpensive to manufacture and which matches in with the particular wall or tile colour.

According to the invention, this problem is solved by a holding device, in which at least the outer wall surface of the holding member is made from a transparent to clear material and whose inner face is roughened as a result of an unglazed construction. A holding device constructed in this way matches the wall surface to which it is fixed, in that it reflects or allows its colour to show through, so that it automatically adapts to the background, without itself being colored.

The holding member of the holding device preferably has a support part and a surrounding jacket or sleeve, which preferably spacedly surrounds the support part. This offers the advantage that an insert adapted to the wall colour can be inserted between the support part and the sleeve of the holding member and this aids the colour adaptation of the holding device to the particular wall cover. An air space on the inside of the sleeve also permits a reflecting construction of the back of said sleeve and use is preferably made of this.

The support part is preferably joined to the sleeve on the wall side. According to a preferred embodiment, the support part and sleeve are constructed in one piece. They can be produced by a plastic injection moulding process, polycarbonate advantageously being used as the raw material. According to a preferred embodiment, with the holding member sleeve is associated a cover, which is preferably also made from a transparent to clear material and whose inner surface is also roughened by an unglazed construction. This cover can be constructed as a cap, whose sleeve passes into the holding member sleeve, so that the viewer considers the holding device to be a closed, uniformly constructed unit. To simplify the fitting of the cover, the latter and/or the support part and/or its shell, has holding members for locking the cover. Embodiments of the holding device according to the invention in which the sleeve and/or cover have a preferably internal profile arrangement have proved to be particularly advantageous. These profiles can consist of ribs in the form of splines having flat sides converging at an angle, the ribs of the shell preferably being parallel to one another, whilst the ribs on the cover have a radial configuration. The ribs preferably have planar surfaces which are advantageously arranged in such a way that there is a total reflection of the incident light.

A reception opening can be provided in the support part for fixing the shower post. According to another embodiment, the support part has in per se known manner a laterally projecting lug, which can be coupled to a free end of the shower post and the lug is preferably constructed in such a way that the free shower post end can be mounted on the lug with a firm seat.

In order to ensure a clean transition between the holding member and the shower rod, the sleeve surrounding the support member and optionally also the cover is provided with a recess adapted to the shower post profile. The support part and the sleeve surrounding the latter are preferably cylindrical in each case.

BRIEF DESCRIPTION OF THE DRAWINGS

Further details and features of the preferred embodiments of the invention can be seen in the drawings, wherein;

FIG. 1 is a side view, partially broken away, of a shower post and holding device according to this invention; and, FIG. 2 is a section view taken along the line II—II in FIG. 1.

DETAILED DESCRIPTION OF THE PREFERRED EMBODIMENTS

The represented shower post 1 has a circular cross-section, is hollow and at both ends is kept spaced from a wall (not shown) by a holding device 2 according to the invention. The two holding devices 2 have an identical construction. Both have a cylindrical support part 3, which is surrounded by a cylindrical sleeve 4, the internal diameter of sleeve 4, arranged concentrically with respect to support part 3, is larger than the external diameter of the latter, so that between support part 3 and sleeve 4, there is an annular space 5 in plan view. Support part 3 and sleeve 4 are constructed in one piece with a plate 6 arranged on the wall side and whose external diameter corresponds to the external diameter of sleeve 4. Plate 6 has a thickened portion, pointing towards the inside of support part 3, with a central opening for an assembly screw 7.

A lug 8 is fixed to support part 3 and on this is mounted one end of the shower post 1. A cap-like cover 9 is mounted on sleeve 4 and has an all-round clamping rim 10 and a recess for sliding in the shower post 1. A corresponding recess is provided in sleeve 4, so that it is ensured that the slide-in end of post 1 is completely surrounded by sleeve 4 and/or cover 9.

Support part 3, sleeve 4, plate 6 and cover 9 are made from a clear plastic, preferably polycarbonate. Internally, sleeve 4 and cap 9 are provided with reflecting profiles 11, 12, 13, which consist of ribs in the form of splines having flat converging sides. Ribs 11 of sleeve 4 run parallel to one another, as do the ribs 12 on the rim of cover 9. However, the ribs 13 on the bottom of the cover have a radial configuration. The fact that the support part 3, sleeve 4 and cover 9 are in each case made from transparent material and are provided with the aforementioned ribs means that it is not possible to see into the interior of support part 3, i.e. the head of assembly screw 7 is invisible and the colour of the wall on which the two holding devices 2 are mounted shows through. The two holding members 2, which were colourless prior to fitting, after fitting to a coloured wall give the appearance that they have assumed the wall colouring. This color accepting effect can be increased in that prior to attaching cover 9, a coloured paper strip with the same colour as the wall is inserted into the space 5 between support part 3 and sleeve 4.

It is also possible to utilize the aforementioned colour accepting effect for other bathroom fittings, e.g. towel rails, soap dish holders, etc, provided that their wall side part is constructed in such a way that at least their outer wall surface is made from a transparent to clear material and its inner surface is roughened as a result of an unglazed design.

The angle enclosed by the sides of ribs 11 is preferably in each case smaller than 75° and is preferably max. 60°.

The inside surface of the holding member is possibly roughened in such a way that between the individual faces of the inside there are total reflections, whereby the individual faces can be sloping surfaces of ribs, projections or irregularly designed unevennesses. The total reflection gives a large mirror effect, without it being necessary to silver the inside of the holding member.

At a boundary between materials having different indices of refraction, rays of light are refracted, i.e., bent, either toward or away from a line normal to the boundary. The extent of refraction depends on the angle of incidence. For rays of light passing from a higher to lower index material such as rays in plastic incident on a boundary with air, the rays are bent away from a line normal to the boundary surface by an angle that is greater for rays striking the boundary at a lower angle of incidence. At a so-called "critical angle" determined by the respective indices of refraction, rays are refracted so far from the normal line that they remain within the material of higher refractive index. Rays incident at or below the critical angle are totally internally reflected at the boundary. The sine of the critical angle is equal to the quotient of the indices of refraction across the surface. The index of refraction of air is defined as 1.0; the index of refraction of plastic such as polycarbonate is approximately 1.5. Therefore, the critical angle for a plastic/air boundary (arcsin 0.67) is about 42°.

According to the invention, rays radially incident on the sleeve, i.e., normal to the outer surface, will strike the plastic/air surface at an angle of incidence equal to half the angle at which the planar sides of the ribs converge. Of course, not all the incident rays will be radially incident on the sleeve. Therefore, the preferred maximum angles enclosed by the sides of the ribs (75° or preferably 60°) are less than twice the critical angle, and accordingly achieve total reflection of a corresponding portion of the incident light in addition to the radially incident light. For greater proportions of total internal reflection, and therefore a larger mirror effect, even steeper sides can be provided on the ribs. The result of a steeper angle will be a larger number of ribs and as the number increases the surface appears more diffuse and less faceted.

What is claimed is:

1. A holding device for a shower post, comprising:

at least one support member, having means for receiving a fixing element adapted for connection to a wall, and means for receiving the shower post, the support member spacing the shower post at a distance from the wall;

a sleeve surrounding the support member and spaced from the support member, the sleeve being made from a transparent material and the sleeve having roughened inner surface, whereby the holding device appears to assume the color of the wall.

2. A device according to claim 1, wherein the support member is connected to the sleeve adjacent the wall, the support part and the sleeve being constructed in one piece of plastic.

3. A device according to claim 2, further comprising a cover attachable to the sleeve at an end opposite the wall, the cover being made from a transparent material, the sleeve having a roughened inner surface, the cover being constructed as a cap dimensioned to fit within the sleeve.

4. A device according to claim 3, wherein at least one of the cover and the sleeve have holding members for affixing the cover to the sleeve.

5. A device according to claim 3, wherein an inner surface of at least one of the sleeve and the cover is roughened by means of a profile system defining a repetitive pattern on said inner surface.

6. A device according to claim 5, wherein the profile system comprises ribs having converging flat sides, the ribs of the sleeve running parallel to one another.

7. A device according to claim 6, wherein the ribs on the inner surface of the cover radiate from a point on the cap, and at their ends align with the ribs of the sleeve.

8. A device according to claim 1, wherein the sleeve and the cover define an opening dimensioned to fit the shower post.

9. A device according to claim 5, wherein the profile system on the inner surface of the sleeve has planar surfaces converging to enclose an angle smaller than 75°, whereby there is total reflection of a portion of light rays incident on the device, between individual planar surfaces on the inside of the sleeve.

10. A device according to claim 9, wherein the planar surfaces enclose an angle smaller than 60°.

* * * * *